United States Patent [19]

Ross, Jr.

[11] Patent Number: 5,036,974

[45] Date of Patent: Aug. 6, 1991

[54] GOLF BAG STAND

[75] Inventor: Cecil J. Ross, Jr., Portland, Oreg.

[73] Assignee: Gordon C. Badgley, Portland, Oreg.

[21] Appl. No.: 568,238

[22] Filed: Aug. 16, 1990

[51] Int. Cl.[5] ..... A63B 55/00

[52] U.S. Cl. ..... 206/315.7; 248/96

[58] Field of Search ..... 248/96, 97, 171, 169, 248/166; 206/315.7, 315.3

[56] References Cited

U.S. PATENT DOCUMENTS

| | | | |
|---|---|---|---|
| 2,672,311 | 3/1954 | Schiele | 248/96 |
| 3,195,844 | 7/1965 | Roepke | 248/171 X |
| 4,215,839 | 8/1980 | Gibran | 248/170 |
| 4,226,389 | 10/1980 | Neth | 248/96 |
| 4,506,854 | 3/1985 | Kim | 248/96 |
| 4,620,682 | 11/1986 | Yim | 248/96 |
| 4,676,464 | 6/1987 | Reimers | 248/96 |
| 4,778,136 | 10/1988 | Reimers | 248/96 |
| 4,798,357 | 1/1989 | Cho | 206/315.7 X |
| 4,834,235 | 5/1989 | Solheim et al. | 248/96 X |
| 4,921,192 | 5/1990 | Jones | 248/96 |

*Primary Examiner*—Ramon O. Ramirez

*Attorney, Agent, or Firm*—James D. Givnan, Jr.

[57] ABSTRACT

A golf bag stand including legs swingably outward from a bag mounted bracket. An actuator for the legs is of U-shape having arm upper ends adjustably attached to leg carried plates. The plates define upper and lower sockets enabling positioning of the actuator to an inactive, raised position where the lower end of the actuator is above the leg lower end and out of ground contact. Positioning of the actuator arm ends downwardly in the leg mounted plates positions the actuator lower end for contact with the ground for automatic leg deployment. upon lifting of the bag out of ground contact, the spring arms of the actuator close the legs toward one another to cause the stand legs to converge to a retracted position.

5 Claims, 1 Drawing Sheet

GS

GOLF BAG STAND

BACKGROUND OF THE INVENTION

The present invention pertains generally to golf bags and particularly to a bag with a stand having automatically deployed and retracted legs.

In the prior art are several stand assemblies for golf bags with the stands including a pair of legs swingable about pivot means. Further, the prior stands utilize ground contacting actuators which serve to deploy the legs outwardly away from an upright bag to a bag supporting position. Examples of such bag and stand construction are found in U.S. Pat. Nos. 4,506,854 and 4,620,682. Both of the stands disclosed utilize a tubular support member extending the length of the golf bag. The actuator components are U-shaped and pivotally secured at points along the legs of the stand. The prior art stands encounter a drawback from a stability standpoint in that the leg members are of a length approximating one-half of the bag height. A further drawback is the weight contributed by the stand to the overall golf bag weight. A still further drawback to the prior art stands is the use of relatively short supporting legs that renders the golf bag unstable when placed on uneven ground surfaces. U.S. Pat. No. 4,620,682 requires that the stand be repositioned along a tubular support to deactivate the stand actuator.

Other prior art golf bag stands are disclosed in U.S. Pat. No. 4,226,389 which discloses a pair of diverging stand legs which swing to a deployed position while U.S. Pat. No. 4,676,464 relies on a strap actuated, bridle arrangement to lift the legs into place against the bag upon termination of ground contact. A modified form of the last described stand utilizes bungee cords which serve to extend the legs for ground contact. Such an arrangement is also disclosed in U.S. Pat. No. 4,778,136.

SUMMARY OF THE PRESENT INVENTION

The present invention is embodied within a golf bag stand which permits automatic deployment and retraction of stand legs as well as convenient positioning of the actuator to immobilize same to permit storage of the bag on its base. A bracket of the stand is attachable to the upper portion of the golf bag and includes pivot means mounting each of the stand legs for outward movement in a diverging manner to a deployed operable position. A flexible actuator has a lower end for ground contact while the actuator upper ends are pivotally coupled to the legs to deploy as well as restract the legs. Accordingly, the legs swing about pivot points adjacent the upper end of the bag to provide a very stable support for the bag with leg deployment being automatic upon contact of the actuator with a ground surface. Conversely, during use at the completion of a golf shot when the bag is lifted away from the ground, the resilient actuator returns to its normal or unsprung configuration and in so doing urges the legs toward one another to retract same into place along bag side. Each leg is provided with an appendage or plate which carries the upper end of the actuator in an adjustable manner to allow the user to manually relocate the actuator relative the bag to operable and inoperable positions, the latter permitting bag placement on a floor surface for upright storage of the bag. For use of the stand, the actuator is repositioned downwardly by fingertip pressure on the upper ends of the actuator to relocate said ends in a lowermost position to extend the actuator end below the golf bag base for ground contact and subsequent leg deployment.

Important objectives of the present golf bag stand include the provision of a golf bag stand having legs which are automatically deployed by a flexible actuator adjustably mounted on the legs; the provision of a golf bag stand having a leg actuator which is manually repositioned along the stand legs to deactivate the actuator by lifting the actuator end above a base of the golf bag permitting golf bag storage on a floor surface; the provision of a golf bag stand which is of lightweight construction; the provision of a golf bag stand having legs with socket defining appendages which adjustably receive the ends of a leg actuator.

DETAILED DESCRIPTION OF THE PREFERRED EMBODIMENT

Figures 1, 2, 3, 4, 5, 6, 7:
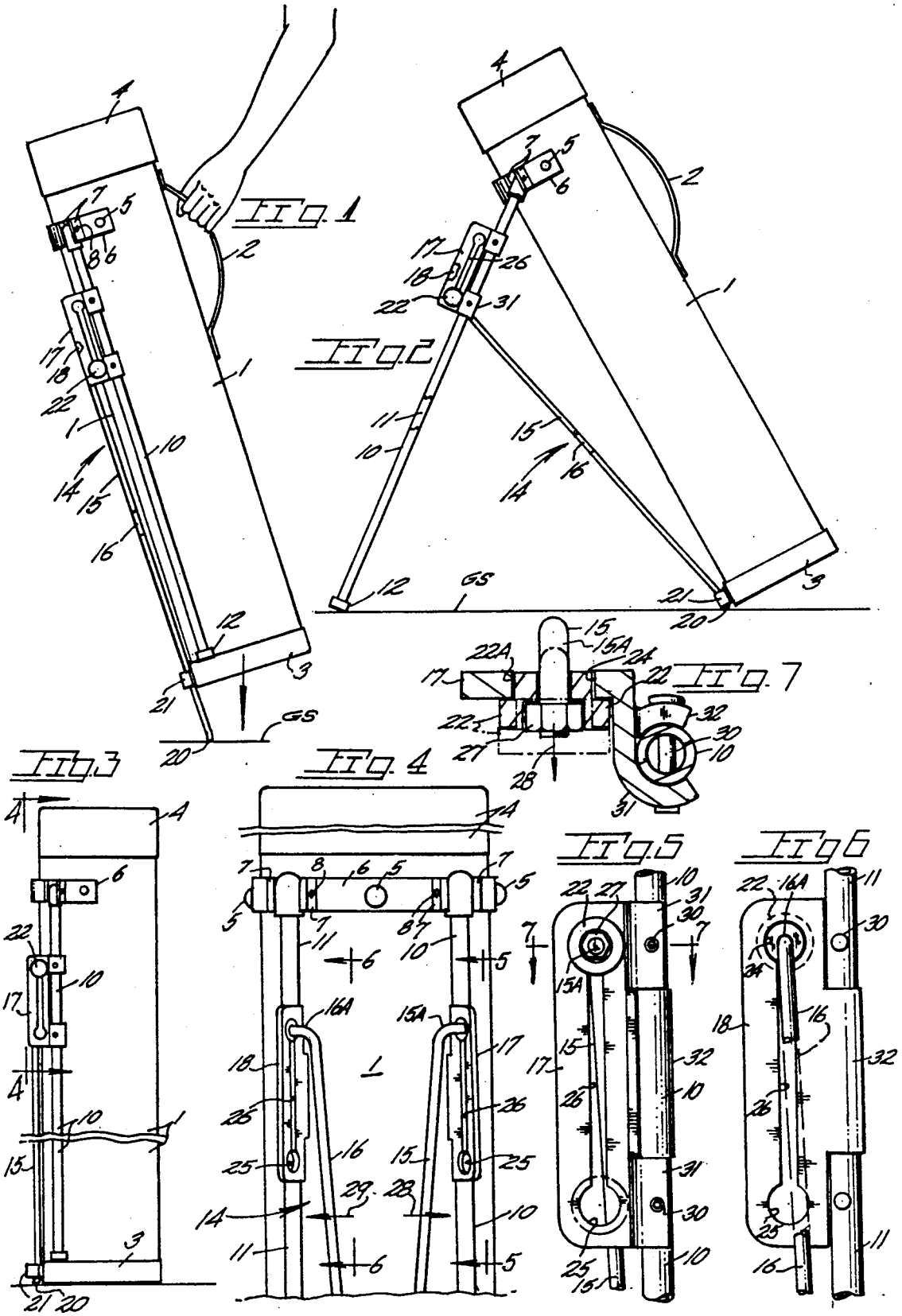
FIG. 1 is a side elevational view of the present stand in place on a golf bag.
FIG. 2 is a view similar to FIG. 1 but with the stand deployed.
FIG. 3 is a view similar to FIG. 1 but with the stand legs elevated for upright bag storage on a floor surface.
FIG. 4 is a front fragmentary elevational view of a golf bag taken along line 4—4 of FIG. 3.
FIG. 5 is a vertical elevational view taken along line 5—5 of FIG. 4.
FIG. 6 is a vertical elevational view taken along line 6—6 of FIG. 4.
FIG. 7 is a horizontal sectional view taken along line 7—7 of FIG. 5.

With continuing attention to the drawings wherein applied reference numerals indicate parts similarly hereinafter identified, the reference numeral 1 indicates a golf bag having a handle 2, a base 3 and a cuff 4 about its upper end.

Secured by fasteners 5 to the upper end portion of the golf bag is a bracket 6 of generally semicircular shape. Divergent pairs of ears 7 project outwardly from bracket 6 and receive pivot pins 8 for the purpose of pivotally mounting legs at 10 and 11. The pairs of ears 7 being in divergent relationship cause legs 10 and 11 to swing about pivots 8 outwardly along divergent paths to the full open position of FIG. 2. Each is equipped with a foot 12 for contact with a ground surface GS.

Coupled to each leg is an actuator 14 of U-shape with flexible spring arms 15–16. Leg mounted appendages at 17 and 18 serve to adjustably couple the upper ends of the actuator arms to the legs as later described while the lowermost end or base 20 of the actuator is slidably confined against the golf bag by guide 21. Retainers at 22 each affixed to the upper end of an actuator at 15,16 are slidably mounted in a leg appendage 17, 18 to permit lengthwise raising and lowering of actuator 14 along the golf bag exterior. Each appendage has an upper socket 24 and a lower socket 25 in communication with one another by a slot at 26. Slot 26 slidably receives the outwardly turned upper end 15A–16A of each actuator arm 15, 16. A nut at 27 is in threaded engagement with each actuator arm end to secure each of the retainers in place. The retainers have annular shoulders as at 22A corresponding to the socket diameter. Dislodgment of the retainers from each of their sockets entails the manual spreading of arms 15, 16 per arrows 28–29 of FIG.

4 whereafter the arm ends 15A–16A may slide along slots 26. For securement of the appendages 17, 18 to their respective legs, rivets 30 pass through the legs and through projections 31 on each appendage. An intermediate projection 32 on each appendage also serves to reinforce appendage attachment to the leg.

Positioning of the arm mounted retainers 22 into the lowermost sockets 25 of the appendages will result in actuator base 20 being offset below an elevated bag base per FIG. 1. Ground contact of actuator end 20, as the bag end is lowered, will cause actuator 14 to impart outward movement to stand legs 10–11. During such leg deployment, the actuator arms 15–16 are sprung or biased apart by the legs as the legs diverge during outward deployment. Upon lifting of the bag out of ground contact, the outwardly biased apart arms 15–16 will close toward one another and hence retract the stand legs 10–11 inwardly along convergent paths to a retracted position against the bag exterior.

While I have shown but one embodiment of the invention, it will be apparent to those skilled in the art that the invention may be embodied still otherwise without departing from the spirit and scope of the invention.

I claim:

1. In combination, a golf bag, a bracket for attachment to the upper portion of the golf bag, legs pivotally attached to said bracket, a leg actuator including a base portion for ground contact when operably disposed, spring arms integral with said base portion, retainers one each at the ends of said arms, guide means on the lower portion of the golf bag slidably receiving said actuator, and actuator attachment means on each of said legs and including upper and lower sockets, said retainers positionable into and out of said sockets to enable elevating of the actuator to an inoperable position to deactivate the actuator by positioning the base portion thereof above the golf bag lower end and out of ground contact.

2. The combination claimed in claim 1 wherein said retainers are disks each having an annular shoulder of a diameter corresponding in size to the upper and lower sockets for retention therein until manually displaced out of said sockets.

3. The combination claimed in claim 2 wherein said spring arms bias the retainers into seated engagement with the sockets with actuator adjustment along the legs subsequent to manual displacement of the retainers out of their respective sockets.

4. In combination, a golf bag, a stand comprising a bracket attached to said golf bag adjacent the upper end of said bag, legs pivotally attached at their upper ends to said bracket for deployment within outwardly diverging planes, actuator means for extending and retracting said legs including a U-shaped member having a pair of spring arms each having a retainer at its distal end, appendages on said legs each defining upper and lower sockets in which a retainer on each of said spring arms may be positioned, a slot extending between the upper and lower sockets of each of said appendages, said U-shaped member having a base contactible with a ground surface when said retainers are in said lower sockets of the appendages to impart deploying movement in divergent planes to said legs resulting in biasing of the spring arms of the actuator apart from one another, said spring arms serving to retract the legs toward the golf bag when the bag and the base of the U-shaped member are lifted by a user out of ground contact, and repositioning of the U-shaped member by relocating of the retainers thereon into said upper sockets of said appendages resulting in the base of said U-shaped member being offset upwardly from the bag lower end and out of ground contact to permit upright bag storage on a floor surface.

5. The combination claimed in claim 4 wherein said retainers each include an annular shoulder for retention of the retainers in said sockets until manually disengaged from said sockets.

* * * * *